US007320356B2

(12) United States Patent
Lehman

(10) Patent No.: US 7,320,356 B2
(45) Date of Patent: Jan. 22, 2008

(54) ELECTROMAGNETIC BRAKE

(75) Inventor: Anders Lehman, Bromma (SE)

(73) Assignee: ABB AB, Västerås (SE)

( * ) Notice: Subject to any disclaimer, the term of this patent is extended or adjusted under 35 U.S.C. 154(b) by 685 days.

(21) Appl. No.: 10/250,972

(22) PCT Filed: Jan. 10, 2002

(86) PCT No.: PCT/SE02/00030

§ 371 (c)(1),
(2), (4) Date: Oct. 23, 2003

(87) PCT Pub. No.: WO02/055234

PCT Pub. Date: Jul. 18, 2002

(65) Prior Publication Data

US 2004/0060786 A1 Apr. 1, 2004

(30) Foreign Application Priority Data

Jan. 10, 2001 (SE) ..... 0100061

(51) Int. Cl.
*B22D 27/02* (2006.01)
*B22D 11/00* (2006.01)

(52) U.S. Cl. ..... 164/502; 164/466

(58) Field of Classification Search ..... 164/502, 164/503, 504, 466, 467, 468
See application file for complete search history.

(56) References Cited

U.S. PATENT DOCUMENTS 4,749,026 A * 6/1988 Metz et al. ..... 164/504
5,664,619 A * 9/1997 Andersson et al. ..... 164/502

FOREIGN PATENT DOCUMENTS

| | | | |
|---|---|---|---|
| JP | 58-44953 | * | 3/1983 |
| JP | 1289543 | | 11/1989 |
| JP | 2-89544 | * | 3/1990 |
| JP | 5177317 | | 7/1993 |
| JP | 8155610 | | 6/1996 |
| JP | 8309487 | | 11/1996 |
| JP | 11285789 | | 10/1999 |
| JP | 2000197952 | | 7/2000 |
| JP | 2000288699 | | 10/2000 |

* cited by examiner

*Primary Examiner*—Kevin P. Kerns
(74) *Attorney, Agent, or Firm*—Venable LLP; Eric J. Franklin

(57) ABSTRACT

A device for braking a flow of molten metal (5) in a device for continuous or semi-continuous casting of metals in a mould (2) which is provided with opposite broad sides (4) and opposite short sides (3), said device comprising at least one magnet core (1), said at least one core facing one of the short sides (3) of the mould (2) for the purpose of generating a magnetic field (B) and an induced current (i) in a region of the molten metal (5) adjacent the short side (3). The core (1) is arranged in such a way that the magnet field (B) which is generated in said region generally has a direction perpendicular from the short side (3) of the mould (2) towards the centre of the latter.

12 Claims, 3 Drawing Sheets

ELECTROMAGNETIC BRAKE

TECHNICAL FIELD

The present invention relates to a device for breaking a flow of molten metal in a device for continuous or semi-continuous casting of metals in a mould which is provided with opposite broad sides and opposite short sides, said device comprising at least one magnet core, said at least one core facing one of the short sides (3) of the mould for the purpose of generating a magnetic field and an induced current in a region of the molten metal adjacent to the short side.

The invention also relates to a method for braking a flow of molten metal in a device for continuous or semi-continuous casting of metals in a mould which is provided with opposite broad sides and opposite short sides.

BACKGROUND OF THE INVENTION

In devices for continuous or semi-continuous casting, it is a well-known fact to brake the flow of metal in a mould by applying one or more magnetic fields to the molten metal. A plurality of different brake configurations have been proposed. Normally, electromagnetic brakes are used, that is brakes that comprise one or more magnetic cores and one or more winding around the latter.

The theory behind braking by means of magnetic fields is based on the fact that a current is induced in the molten metal thanks to the presence of the magnetic fields in accordance with $i=v\times B$, where i is the induced current, v is the velocity of the molten metal, and B is the size of the magnetic field. A force $f=i\times B$ is obtained in the molten metal. According to well known principles, the force f has a direction opposite to the direction of the velocity vector v, and therefore it has braking effect on the flow.

By moulds that have broad sides and short sides, electromagnetic brakes are normally arranged along opposite broad sides. In that way, a magnetic field that covers generally the whole width of the melt can be obtained, However, the induced current in a region adjacent to the short sides will not be able to become closed, but will depart from the molten metal through the shorts side. This, in its turn, results in the braking force f not being obtained in this region.

PRIOR ART

The Japanese patent application 62-336874 discloses an arrangement of magnets at opposite short sides of a mould for the purpose of braking the flow of molten metal during continuous casting of metals in the mould. At each short side, a south pole and a north pole are arranged beside each other, both poles being adjacent to the short side. A magnetic field between the poles is formed in the molten metal. The magnetic field has an arc-shape in the melt and extends with an angle into the melt from each one of the poles.

A drawback of the disclosed arrangement, in particular when combined with conventional brake devices located along the broad sides, is that the magnetic field thereby created has such a direction that at least a substantial part of the current induced in the region close to the short sides still has a tendency not to get closed, resulting in a reduced braking power f in this region.

A further drawback is the fact that both the poles have a small width in the width direction of the short side. Therefore, they obtain their magnetic saturation at a relatively early stage.

THE OBJECT OF THE INVENTION

It is an object of the invention to present a device and a method of the kind initially defined that generates a magnetic field in the molten metal in a region close to at least one of the short sides of the mould, such that a satisfying braking force f acting on the melt is obtained in this region.

The device according to the invention shall be able to supplement, in an advantageous way, the action of a braking device having magnets arranged along the broad sides of the mould.

The device according to the invention shall be designed in such a way that the saturation threshold of the magnet core or the magnet cores is high, that is that a relatively powerful magnetic field can be formed without saturation of the magnetic core or cores.

SUMMARY OF THE INVENTION

The object of the invention is obtained by means of a device as initially defined, which is characterized in that the core is arranged in such a way that the magnetic field generated in said region generally has a direction perpendicularly from the short side of the mould towards its centre. The current i that is induced in the region adjacent the mould wall then gets a direction generally parallel thereto, and it also becomes closed. A force f that brakes the molten metal in said region is thus obtained.

Preferably, the at least one core has a width of at least 50%, preferably at least 75%, and most preferably at least 95% of the width of the short side of the mould. In that way, it is guaranteed that the capacity of the core is sufficient, meaning that a magnetic field with sufficient width and strength can be generated. Thereby, the magnetic fields extends generally from the front portion of the core, via the short side of the mould, into the molten metal, and out of the molten metal via the broad sides of the mould, and further on to a rear portion of the core, said rear portion forming an opposite pole to the front portion.

The width of the at least one core generally corresponds to the width of the short side of the mould. It is arranged generally in the middle between two opposite edges of the short side of the mould. In that way a covering and a well distributed magnetic field is obtained over generally the whole width of the short side.

Preferably, the device comprises at least one winding wound around the core, and defines an electromagnetic brake. The winding should be displaceably arranged on the core in a direction to or from the short side of the mould. This embodiment is particularly advantageous in the case where the short sides are arranged displaceably in relation to the broad sides for the purpose of changing the width of the casted strand. The core can then be displaced together with the short sides without the winding colliding with the broad sides. The core is permitted to have a width that corresponds to the width of the short side, and no further space needs to be prepared for the winding between the broad sides.

In the case in which the mould is generally vertically arranged, the core should be arranged in or below the region in which a flow of molten metal impinges the inner surface of the short side of the mould in a direction obliquely downwards.

The object of the invention is also obtained by means of the initially defined method, which is characterized in that a magnetic field is induced in the molten metal from at least one short side, the magnetic field, in a region in the molten metal which is adjacent to the short side, having a direction generally vertically from the short side in a direction towards the middle of the mould.

The magnetic field should depart from at least 50%, preferably at least 75%, and most preferably at least 95% of the width of the short side. Thereby, a good distribution and width of the field is obtained, such that an induced current with a closed loop is induced in the molten metal in said region, and such that the braking force f is obtained. Therefore, the magnetic field preferably covers generally the whole width of the short side in said region, and the braking force f is obtained over a part, as large as possible, of the region of the molten metal adjacent to the short side.

The invention also relates to a use of the device according to the invention for the purpose of braking a flow of molten metal in a region along at least one short side of a mould.

Further advantages and features of the invention will be disclosed in the following description.

BRIEF DESCRIPTION OF THE DRAWINGS

The invention will now be explained by way of example with reference to the annexed drawings, in which.

DETAILED DESCRIPTION OF THE INVENTION

Figure 1:
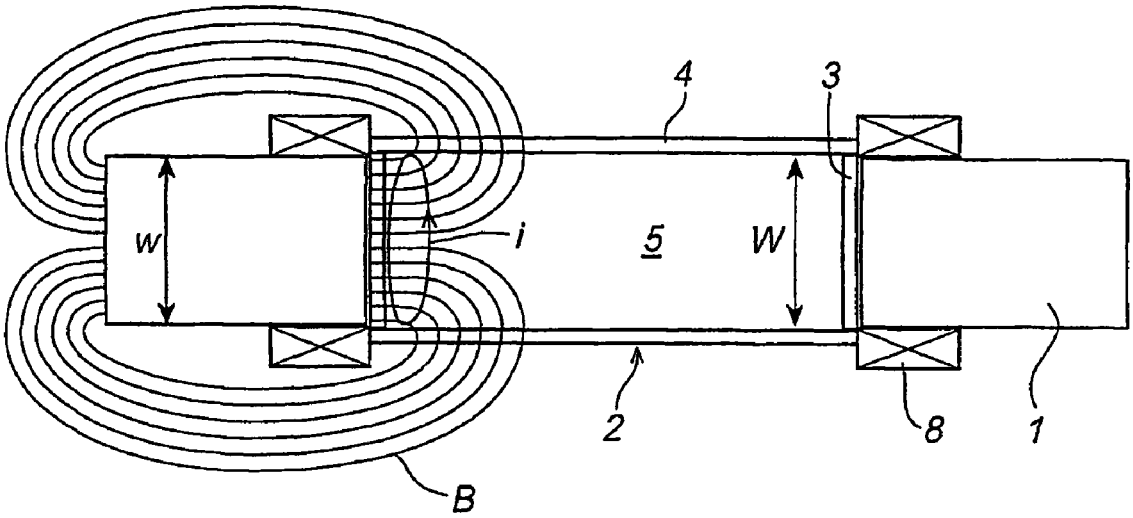
FIG. 1 is a view from above of an embodiment of the device according to the invention.
Figure 2:
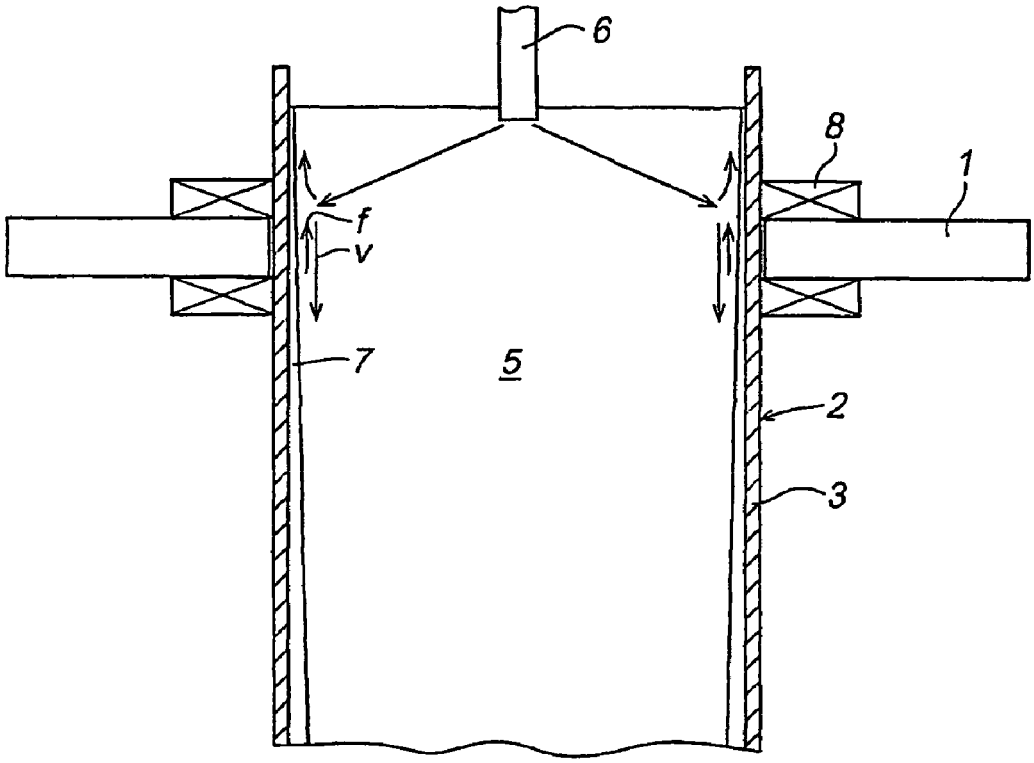
FIG. 2 is a view from the side of the device according to FIG. 1.
Figure 3:
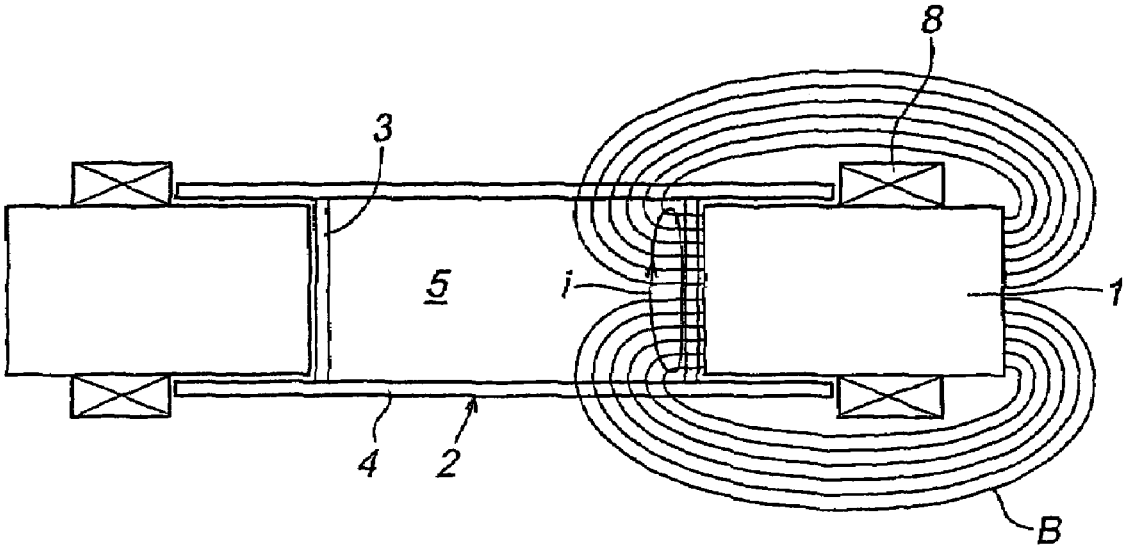
FIG. 3 is a view from above of the device according to FIG. 1, but with displaced mould short sides and magnetic cores.

FIGS. 1-3 show a first embodiment of the device according to the invention. The device comprises two magnetic cores 1, for example iron cores, that are arranged at a mould, a copper mould 2.

The mould 2 has opposite short sides 3 and broad sides 4. Preferably, it is made of a copper alloy with a very high percentage of copper. The mould 2 is arranged vertically and open in the top and in the bottom for the purpose of permitting a continuous or semi-continuous casting of metal, for example steel, therein.

A melt 5 of metal is delivered to the mould through a tube 6 that extends down into the mould from above. The molten metal 5 is permitted to move downwards through the mould 2, while it solidifies and forms a skin 7 at its periphery. In a region (impinging point) below the end of the casting tube 6, the down-flowing molten metal 5 impinges the inner walls of the short sides 3 with an oblique angle and with a raised velocity. Thereby, a part of the molten metal 5 is guided upwards, such as shown by the arrows in FIG. 2, while another part continues downwards along the periphery of the casted strand. A corresponding region is also present along the broad sides.

Each of the magnet cores 1 has a width w that generally corresponds to the width W of each of the short sides 3 of the mould 2. Each core 1 has a front portion which is adjacent the outer surface of a respective short side 3. A winding 8 of an electrical conductor is arranged around each of the magnet cores 1. The magnet cores have the shape of a rod that extends perpendicularly from the short sides 3, and the winding 8 is wound around the rod. The device comprises means (not shown) for generating a current in the winding in a way known per se, such that a magnetic field B is created. The magnetic field B will extend into the molten metal 5 from said front portion, depart from the molten metal 5 through the broad sides 4, and return to a rear part of the core 1 that forms an opposite pole to its front portion. In a region adjacent to the inner surface of the short sides 3, and inside the skin 7, the flow lines of the magnetic field B have a direction generally perpendicular to the short side 3 and generally parallel to the plane of the broad sides 4 towards the centre of the melt 5.

The direction of the magnetic field B in said region is such that a closed induced current i is induced in the molten metal 5. The induced current i, in co-operation with a velocity component v of the molten metal, results in a braking force f which is directed upwards.

In FIG. 3, it can be seen that the short sides 3 are displaceable in relation to the broad sides 4 for the purpose of adjusting different width/thickness relations of the strand which is casted by means of the device. For the purpose of decreasing the width of the strand (along the broad sides) the short sides 3 are pushed inwards between the broad sides 4.

The windings 8 are displaceably arranged on the cores 1. Thereby, a displacement of the cores 1 that corresponds to the displacement of the short sides 3 is permitted without the need of displacing the winding 8 in each core inwards between the broad sides 4.

Figure 4:
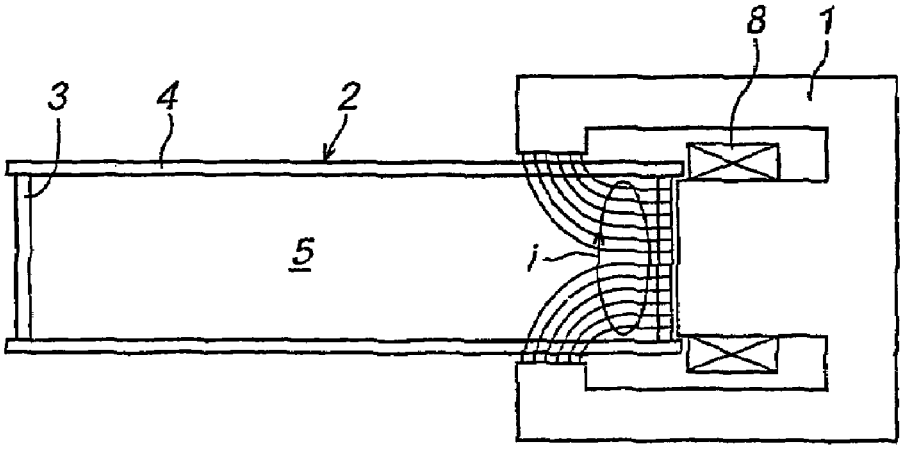
FIG. 4 is a view corresponding to the one in FIG. 2 of an alternative embodiment of the device according to the invention.

FIG. 4 shows an alternative embodiment of the magnet cores 1. In this embodiment, each core 1 comprises an extension that extends on the exterior of at least one, preferably both of the broad sides 4 of the mould 2 when the portion of the core 1 that is located most adjacent to the short side 3 of the mould is located in an operative position adjacent to short side 3. By such a construction, there is obtained a further control of the extension of the magnetic field B. In particular, it is avoided that the magnetic field is diverging outwards towards the broad sides 4 at a too early stage.

Figure 5:
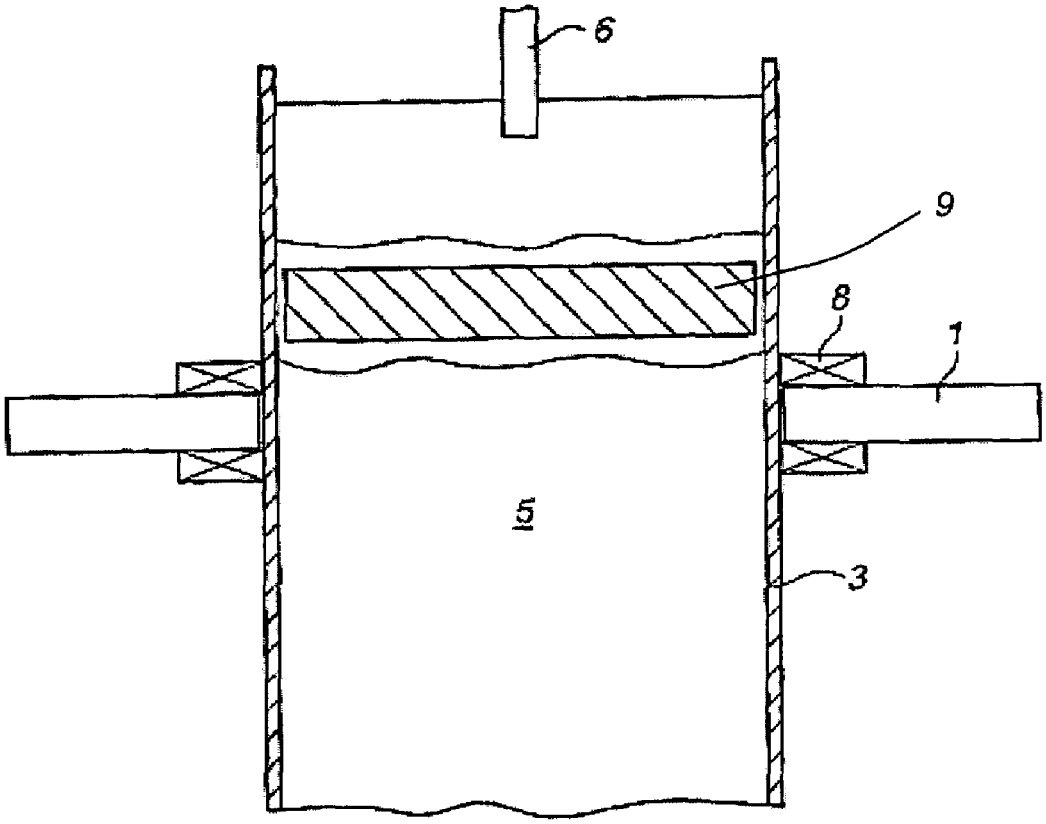
FIG. 5 is a side view of an embodiment of the invention with a braking device located along the broad sides of the mould.

FIG. 5 shows an embodiment in which the device forms a complementary brake to an electromagnetic brake 9 arranged along at least one of the broad sides 4 of the mould 2. The brake 9 is preferably an electromagnetic brake. The magnet cores 1 at the short sides are, here, arranged at a lower level than the brake device 9, but it should be realized that there are a plurality of different brake configurations on the market today, and that, therefore, the position of the magnet cores 1 in relation to such brake devices may vary from case to case. It should also be realized that the device according to the invention suitably is combined with and forms a supplement to an electromagnetic stirrer (not shown).

It should be realized that a plurality of alternative embodiments of the invention will be obvious for a man skilled in the art without thereby going beyond the scope of the invention such as defined in the annexed patent claims supported by the description and the annexed drawings.

For example, the magnet cores at the opposite short sides may be different or identic. They may also be arranged at different levels depending on different factors, such as the level of the region where the flow of metal with raised velocity from the casting tube 6 impinges the wall surfaces.

In FIG. 4 only one magnet core 1 with a magnet winding 8 associated thereto has been shown. However, it should be realized that the embodiment preferably comprises another core 1, arranged at the opposite short side.

Moreover, it is possible to have different brake configurations, where a plurality of magnets are arranged at each short side, on different levels.

It should be added that the winding 8, for the best possible effectivity, is arranged as close to the short side of the mould as possible, for minimizing the air gap between the mould and the winding. The invention promotes such a positioning of the winding.

The invention claimed is:

1. A device for braking a flow of molten metal in a device for continuous or semi-continuous casting of metals in a mold which is provided with opposite broad sides and opposite short sides, the device comprising:

two magnet cores facing a respective one of the short sides of the mold for generating a magnetic field and an induced current in a region of the molten metal adjacent to each respective short side, the cores being arranged such that the magnetic field generally has a direction perpendicular from the respective short side of the mold towards the center of the latter, wherein the mold is generally vertically arranged and at least one of the cores is arranged in or below a region wherein a flow of molten metal impinges the inner surface of an short side of the mold in a direction obliquely downwards; and a winding comprising an electric conductor wound around each magnet core.

2. The device according to claim 1, wherein at least one of the cores has a width covering at least 50% of the width of the short side of the mold.

3. The device according to claim 1, wherein the width of at least one of the cores generally corresponds to the width of the short side of the mold.

4. The device according to claim 1, wherein at least one of the cores is arranged generally in the middle between two opposite edges of the short side of the mold.

5. The device according to claim 4, wherein the winding is displaceably arranged on at least one of the cores in a direction to or from the short side of the mold.

6. The device according to claim 1, wherein at least one of the cores and one of the short sides of the mold are displaceably arranged in a direction to and from the opposite short side of the mold.

7. The device according to claim 1, wherein at least one of the cores composes an extension which extends on the exterior of at least one of the broad sides of the mold when the portion of the core which is located most adjacent the short side of the mold is positioned in an operative position adjacent said short side.

8. The device according to claim ,1 wherein the device forms a complementary brake to an electromagnetic brake that is arranged along a at least one of the broad sides of the mold.

9. Use of a device according to claim 1 for the purpose of braking a flow of molten metal in a region along the opposite short sides of a mold.

10. The device according to claim 1, wherein at least one of the cores has a width covering at least 75% of the width of the short side of the mold.

11. The device according to claim 1, wherein at least one of the cores has a width covering at least 95% of the width of the short side of the mold.

12. The device according to claim 1, wherein at least one of the cores comprises an extension which extends on the exterior of both of the broad sides of the mold when the portion of the core which is located most adjacent the short side of the mold is positioned in an operative position adjacent said short side.

* * * * *